US009037033B2

(12) United States Patent
Ohno

(10) Patent No.: US 9,037,033 B2
(45) Date of Patent: May 19, 2015

(54) IMAGE FORMING APPARATUS AND METHOD FOR DRIVING AND CONTROLLING FANS IN THE APPARATUS

(75) Inventor: Yoshinori Ohno, Toyokawa (JP)

(73) Assignee: KONICA MINOLTA BUSINESS TECHNOLOGIES, INC., Chiyoda-Ku, Tokyo (JP)

( * ) Notice: Subject to any disclaimer, the term of this patent is extended or adjusted under 35 U.S.C. 154(b) by 744 days.

(21) Appl. No.: 13/191,637

(22) Filed: Jul. 27, 2011

(65) Prior Publication Data

US 2012/0026689 A1 Feb. 2, 2012

(30) Foreign Application Priority Data

Jul. 29, 2010 (JP) ..... 2010-171213

(51) Int. Cl.
*G03G 15/00* (2006.01)
*F04D 25/16* (2006.01)
*G03G 21/20* (2006.01)

(52) U.S. Cl.
CPC ..... *F04D 25/166* (2013.01); *G03G 21/206* (2013.01)

(58) Field of Classification Search
CPC . G03G 15/2021; G03G 21/20; G03G 21/206; F04D 25/166
USPC ..... 399/91–93
See application file for complete search history.

(56) References Cited

U.S. PATENT DOCUMENTS

| | | | | |
|---|---|---|---|---|
| 7,623,822 | B2 * | 11/2009 | Matsuno | 399/400 |
| 2009/0324276 | A1 * | 12/2009 | Kakutani | 399/92 |
| 2010/0290804 | A1 * | 11/2010 | Sakuwa | 399/92 |

FOREIGN PATENT DOCUMENTS

| | | | |
|---|---|---|---|
| CN | 201448270 | U | 5/2010 |
| JP | 6-258903 | | 9/1994 |
| JP | 2000-250381 | A | 9/2000 |
| JP | 2001-242769 | | 9/2001 |
| JP | 2008-242488 | A | 10/2008 |
| JP | 2009-58587 | A | 3/2009 |

OTHER PUBLICATIONS

Chinese Office Action (The First Office Action) dated Oct. 24, 2013, issued by the Chinese Patent Office in corresponding Chinese Patent Application No. 201110220893.7, and English language translation of Office Action. (14 pages).
Office Action/Search Report issued on Aug. 4, 2014, by the Chinese Patent Office in corresponding Chinese Patent Application No. 201110220893.7 and an English translation of the Office Action/Search Report. (16 pages).

* cited by examiner

*Primary Examiner* — Walter L Lindsay, Jr.
*Assistant Examiner* — Jessica L Eley
(74) *Attorney, Agent, or Firm* — Buchanan Ingersoll & Rooney PC

(57) ABSTRACT

An image forming apparatus includes a plurality of fans, a drive part and a controller. The drive part drives each of the fans. The controller controls the drive part in such a way that while the apparatus is operated, a part of the plurality of fans are stopped and the fan to be stopped is changed and the amount of change in a noise level of all the fans before and after the change of the fan to be stopped is limited to within a specified range.

18 Claims, 6 Drawing Sheets

Control sequence of fans according to the number of sheets of paper to be continuously fed in a mode of color/single-side printing/A4Y/non-stapler

| | | The number of sheets of paper to be continuously fed | | | | |
|---|---|---|---|---|---|---|
| | | 1～50 | 51～100 | 101～150 | 151～200 | ··· |
| Fan 1 | Sirocco fan | Full speed | Full speed | Full speed | Full speed | ··· |
| Fan 2 | Sirocco fan | Full speed | Full speed | Full speed | Full speed | ··· |
| Fan 3 | Sirocco fan | Full speed | Full speed | Full speed | Full speed | ··· |
| Fan 4 | Sirocco fan | Full speed | Full speed | Full speed | Full speed | ··· |
| Fan 5 | Sirocco fan | Stopped | Low speed | Low speed | Full speed | ··· |
| Fan 6 | Axial fan | Stopped | Full speed | Stopped | Full speed | ··· |
| Fan 7 | Axial fan | Full speed | Low speed | Low speed | Low speed | ··· |
| Fan 8 | Axial fan | Low speed | Stopped | Full speed | Stopped | ··· |
| Fan 9 | Axial fan | Low speed | Full speed | Stopped | Low speed | ··· |
| Fan 10 | Axial fan | Stopped | Low speed | Full speed | Stopped | ··· |
| Fan 11 | Axial fan | Low speed | Low speed | Stopped | Full speed | ··· |
| Fan 12 | Axial fan | Low speed | Stopped | Full speed | Stopped | ··· |
| | | Pattern B | Pattern C | Pattern D | Pattern E | |

| | | Display acoustic power level [dB] | |
|---|---|---|---|
| | | Full speed | Low speed |
| Fan 1 | Sirocco fan | 56 | 44 |
| Fan 2 | Sirocco fan | 56 | 44 |
| Fan 3 | Sirocco fan | 56 | 44 |
| Fan 4 | Sirocco fan | 56 | 44 |
| Fan 5 | Sirocco fan | 56 | 44 |
| Fan 6 | Axial fan | 43 | – |
| Fan 7 | Axial fan | 54 | 45 |
| Fan 8 | Axial fan | 47 | 39 |
| Fan 9 | Axial fan | 53 | 44 |
| Fan 10 | Axial fan | 54 | 45 |
| Fan 11 | Axial fan | 53 | 44 |
| Fan 12 | Axial fan | 49 | 40 |

Control sequence of fans according to the number of sheets of paper to be continuously fed in a mode of color/single-side printing/A4Y/non-stapler

| | | The number of sheets of paper to be continuously fed | | | | |
|---|---|---|---|---|---|---|
| | | 1～50 | 51～100 | 101～150 | 151～200 | ・・・ |
| Fan 1 | Sirocco fan | Full speed | Full speed | Full speed | Full speed | ・・・ |
| Fan 2 | Sirocco fan | Full speed | Full speed | Full speed | Full speed | ・・・ |
| Fan 3 | Sirocco fan | Full speed | Full speed | Full speed | Full speed | ・・・ |
| Fan 4 | Sirocco fan | Full speed | Full speed | Full speed | Full speed | ・・・ |
| Fan 5 | Sirocco fan | Stopped | Low speed | Low speed | Full speed | ・・・ |
| Fan 6 | Axial fan | Stopped | Full speed | Stopped | Full speed | ・・・ |
| Fan 7 | Axial fan | Full speed | Low speed | Low speed | Low speed | ・・・ |
| Fan 8 | Axial fan | Low speed | Stopped | Full speed | Stopped | ・・・ |
| Fan 9 | Axial fan | Low speed | Full speed | Stopped | Low speed | ・・・ |
| Fan 10 | Axial fan | Stopped | Low speed | Full speed | Stopped | ・・・ |
| Fan 11 | Axial fan | Low speed | Low speed | Stopped | Full speed | ・・・ |
| Fan 12 | Axial fan | Low speed | Stopped | Full speed | Stopped | ・・・ |
| | | Pattern B | Pattern C | Pattern D | Pattern E | |

FIG.5

Control sequence of fans according to the number of sheets of paper to be continuously fed in a mode of monochrome/single-side printing/A4Y/non-stapler

| | | The number of sheets of paper to be continuously fed | | | | |
|---|---|---|---|---|---|---|
| | | 1～40 | 41～80 | 81～120 | 121～150 | ・・・ |
| Fan 1 | Sirocco fan | Full speed | Full speed | Ful speed | Full speed | ・・・ |
| Fan 2 | Sirocco fan | Full speed | Full speed | Ful speed | Full speed | ・・・ |
| Fan 3 | Sirocco fan | Full speed | Full speed | Ful speed | Full speed | ・・・ |
| Fan 4 | Sirocco fan | Full speed | Full speed | Ful speed | Full speed | ・・・ |
| Fan 5 | Sirocco fan | Stopped | Low speed | Low speed | Full speed | ・・・ |
| Fan 6 | Axial fan | Stopped | Full speed | Stopped | Full speed | ・・・ |
| Fan 7 | Axial fan | Full speed | Low speed | Low speed | Low speed | ・・・ |
| Fan 8 | Axial fan | Low speed | Stopped | Full speed | Stopped | ・・・ |
| Fan 9 | Axial fan | Low speed | Full speed | Stopped | Low speed | ・・・ |
| Fan 10 | Axial fan | Stopped | Low speed | Ful speed | Stopped | ・・・ |
| Fan 11 | Axial fan | Low speed | Low speed | Stopped | Full speed | ・・・ |
| Fan 12 | Axial fan | Low speed | Stopped | Ful speed | Stopped | ・・・ |
| | | Pattern B | Pattern C | Pattern D | Pattern E | |

FIG.6

Control sequence of fans according to the number of sheets of paper to be continuously fed in a mode of monochrome/both-side printing/A4Y/non-stapler

| | | The number of sheets of paper to be continuously fed | | | | |
|---|---|---|---|---|---|---|
| | | 1～30 | 31～60 | 61～90 | 91～120 | ··· |
| Fan 1 | Sirocco fan | Full speed | Full speed | Full speed | Full speed | ··· |
| Fan 2 | Sirocco fan | Full speed | Full speed | Full speed | Full speed | ··· |
| Fan 3 | Sirocco fan | Full speed | Full speed | Full speed | Full speed | ··· |
| Fan 4 | Sirocco fan | Full speed | Full speed | Full speed | Full speed | ··· |
| Fan 5 | Sirocco fan | Stopped | Low speed | Low speed | Full speed | ··· |
| Fan 6 | Axial fan | Stopped | Full speed | Stopped | Full speed | ··· |
| Fan 7 | Axial fan | Full speed | Low speed | Low speed | Low speed | ··· |
| Fan 8 | Axial fan | Low speed | Stopped | Full speed | Stopped | ··· |
| Fan 9 | Axial fan | Low speed | Full speed | Stopped | Low speed | ··· |
| Fan 10 | Axial fan | Stopped | Low speed | Full speed | Stopped | ··· |
| Fan 11 | Axial fan | Low speed | Low speed | Stopped | Full speed | ··· |
| Fan 12 | Axial fan | Low speed | Stopped | Full speed | Stopped | ··· |
| | | Pattern B | Pattern C | Pattern D | Pattern E | |

FIG.7

IMAGE FORMING APPARATUS AND METHOD FOR DRIVING AND CONTROLLING FANS IN THE APPARATUS

This application claims priority under 35 U.S.C. §119 to Japanese Patent Application No. 2010-171213 filed on Jul. 29, 2010, the entire disclosure of which is incorporated herein by reference in its entirety.

BACKGROUND OF THE INVENTION

1. Technical Field

The present invention relates to an image forming apparatus provided with a plurality of cooling fans and the like such as a copier, a printer, and a Multi Function Peripherals (MFP) of a multi-function digital complex apparatus, and to a method for driving and controlling the fans in the apparatus.

2. Description of the Related Art

The following description sets forth the inventor's knowledge of related art and problems therein and should not be construed as an admission of knowledge in the prior art.

The image forming apparatus described above is usually provided with a plurality of fans such as a cooling fan for preventing the temperatures of an electronic board, an electric motor, or the interior of the apparatus from being higher than a predetermined temperature during an operation such as a printing operation, a fan for sucking ozone, dust, or the like, and a fan for sucking paper.

These fans cause noises when they are activated, so that it is required for the fans not only to have performances intrinsic to the fans such as cooling performance and sucking performance but also to reduce the noises of all the fans in recent years.

Thus, in Japanese Patent Application Laid-Open No. 2009-58587 is proposed an image forming apparatus having a silent mode in which noises are reduced as compared with an ordinary mode by reducing the noises of the fans leaking from the openings of the apparatus.

Further, in Japanese Patent Application Laid-Open No. 2000-250381 is proposed an image forming apparatus that controls a plurality of cooling fans according to an outside air temperature or on the basis of a temperature detection result to thereby reduce the noises.

However, the image forming apparatus in the prior art including the image forming apparatuses described in Japanese Patent Application Laid-Open No. 2009-58587 and Japanese Patent Application Laid-Open No. 2000-250381 presents such problems that the image forming apparatus is not sufficient in terms of suppressing a noise level and that the noise level of the fans is rapidly changed in some cases depending on the use conditions of the apparatus to be offensive to user's ears.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

SUMMARY OF THE INVENTION

According to a first aspect of the present invention, an image forming apparatus including: a plurality of fans; a drive part for driving each of the fans; and a controller for controlling the drive part in such a way that while the apparatus is operated, a part of the plurality of fans are stopped and the fan to be stopped is changed and the amount of change in a noise level of all the fans before and after the change of the fan to be stopped is limited to within a specified range.

According to a second aspect of the present invention, a method for driving and controlling a plurality of fans in an image forming apparatus provided with the fans, the method including: driving the fans by a drive part in such a way that while the apparatus is operated, a part of the plurality of fans are stopped and the fan to be stopped is changed and the amount of change in a noise level of all the fans before and after the change of the fan to be stopped is limited to within a specified range.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which:

FIG. 5 is a table to show the drive and control sequences of the respective fans while the image forming apparatus is performing a printing operation;

FIG. 6 is a table to show the drive and control sequences of the respective fans while the image forming apparatus is performing another printing operation;

FIG. 7 is a table to show the drive and control sequences of the respective fans while the image forming apparatus is performing still another printing operation.

DETAILED DESCRIPTION OF THE PREFERRED EMBODIMENTS

In the following paragraphs, some preferred embodiments of the invention will be described by way of example and not limitation. It should be understood based on this disclosure that various other modifications can be made by those in the art based on these illustrated embodiments.

Figure 1:
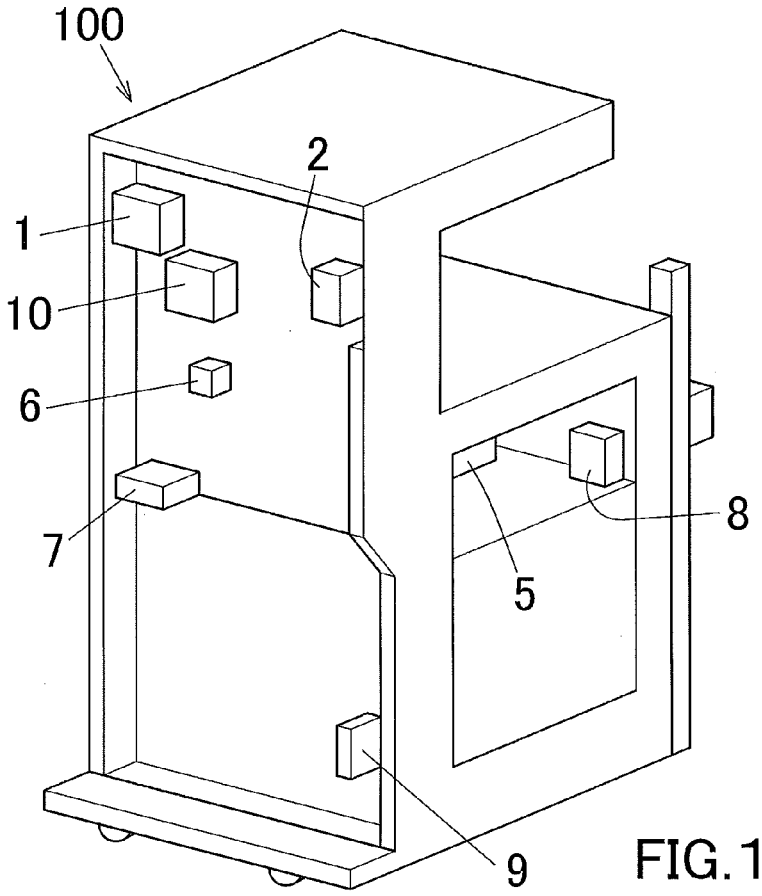
FIG. 1 is a perspective view, when viewed from a rear side, of an image forming apparatus according to one embodiment of the present invention in a state where an outside plate is removed.
Figure 2:
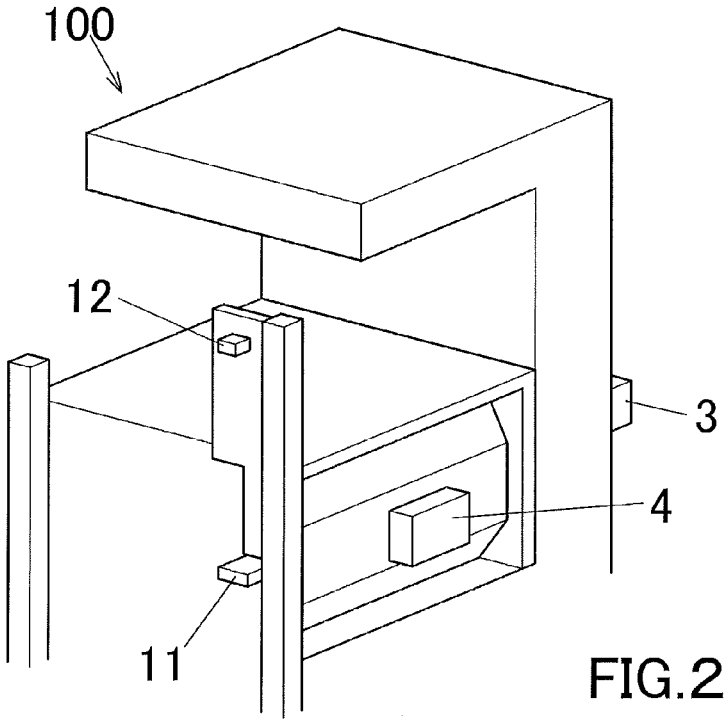
FIG. 2 is a perspective view, when viewed from a front side, of the image forming apparatus in a state where the outside plate is removed.

FIG. 1 is a perspective view, when viewed from a rear side, of an image forming apparatus according to one embodiment of the present invention in a state where an outside plate is removed, and FIG. 2 is a perspective view, when viewed from a front side, of the image forming apparatus in a state where the outside plate is removed.

In this embodiment, an image forming apparatus 100 is provided with a plurality of fans including a paper cooling fan 1, a dust sucking fan 2, an ozone sucking fan 3, a paper sucking fan 4, an imaging unit cooling fan 5, a CPU cooling fan 6, a board cooling fan 7, a polygon motor cooling fan 8, a low-voltage power supply board cooling fan 9, a drive part cooling fan 10, a first IH power supply board cooling fan 11, and a second IH power supply board cooling fan 12. Of these fans, the fans 1 to 4 are constructed of sirocco fans and the fans 5 to 12 are constructed of axial fans. Here, the image forming apparatus 100 is provided with a fixing device using an IH coil.

Figures 3, 4:
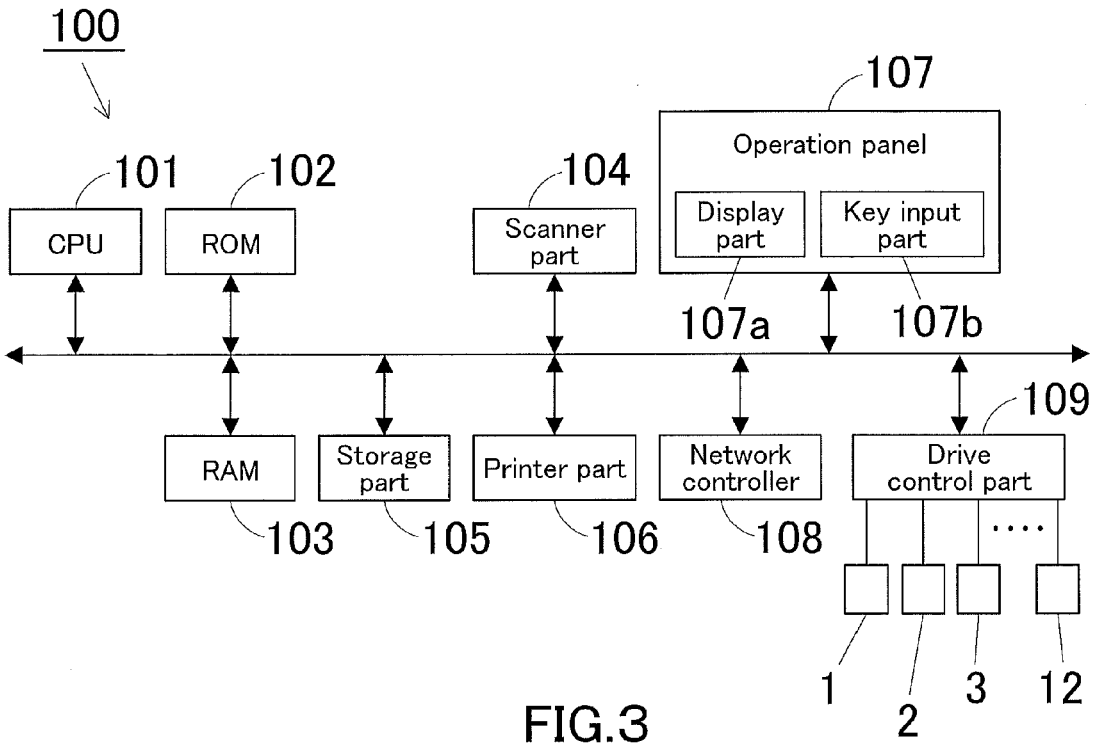
FIG. 3 is a block diagram to show the construction of the image forming apparatus.
FIG. 4 is a view to show a display acoustic power level (noise level of activation sound) when respective fans are activated at full speeds and at low speeds.

FIG. 3 is a block diagram to show the construction of the image forming apparatus 100.

The image forming apparatus 100 employs Multi Function Peripherals (MFP) of a multi-function digital complex machine having a plurality of functions such as a copying function, a printing function, a scanning function, and a faxing function. The image forming apparatus 100 is provided with a CPU 101, a ROM 102, a RAM 103, a scanner part 104, a storage part 105, a printer part 106, an operation panel 107, a network controller (N1C) 108, and a drive control part 109.

The CPU 101 controls the whole of the image forming apparatus 100 in a centralized manner and controls the basic functions such as the copying function, the printing function, the scanning function, and the faxing function in such a way that they can be used. Moreover, the CPU 101 controls the activations of the respective fans 1 to 12 described above via the drive controller 109.

The ROM 102 is a memory for storing an operating program and the like of the CPU 101.

The RAM 103 is a memory for supplying a work area when the CPU 101 is operated on the basis of the operating program.

The scanner part 104 is a part for reading an image of an original manuscript placed on a platen (not shown).

The storage part 105 is constructed of a nonvolatile storage device, for example, a hard disc drive (HDD). In the storage part 105 are stored the operating patterns of the respective fans 1 to 12, image data read by the scanner part 104, and data sent from the other image forming apparatus, a user terminal, and the like.

The printer part 106 is a part for printing the image data of the original manuscript read by the scanner part 104, print data from the user terminal, and the like in an indicated mode.

The operation panel 107 is a part used for various input operations and the like and is provided with a display part 107*a* made of a touch panel type liquid crystal or the like that displays a message and an operating screen and a key input part 107*b* provided with ten keys, a start key, a stop key, and the like.

The network controller 108 controls communications to/from the other image forming apparatus on a network and the other external devices, for example, the user terminal, thereby sending and receiving data.

The drive control part 109 is a part for controlling the operations of the respective fans 1 to 12 under the control of the CPU 101 and is provided with motors for driving the fans for the respective fans.

FIG. 4 is a table to show display acoustic power levels when the respective fans 1 to 12 are activated at full speeds and when the respective fans 1 to 12 are activated at low speeds, in other words, the noise levels of activation sound. When the fans 1 to 4 made of sirocco fans are activated at full speeds, all of the noise levels of the respective fans are 56 dB, and when the fans 1 to 4 are activated at low speeds, all of the noise levels of them are 44 dB. When the fans 6 to 12 made of axial fans are activated at full speeds, the noise levels of the respective fans range from 43 to 56 dB, and when the fans 6 to 12 are activated at low speeds, the noise levels of the respective fans range from 39 to 45 dB. In this manner, the noise levels are different from each other by the functions of the fans, and the noise levels are varied also by the rotation control states of the fans.

FIG. 5 is a table to show the drive and control sequences of the respective fans when the image forming apparatus 100 is performing a printing operation. These drive and control sequences are control sequences when printing is performed on the sheets of paper continuously fed in a printing operation mode of color, single-side printing, A4 lateral size, and without staple handling. Here, the A4 lateral size means a mode in which the sheets of A4 paper are laterally set when they are fed and in which the sheets are carried in a state where they are turned by 90 degrees with respect to a direction when they are ordinarily carried.

In this embodiment, it is assumed that the fans 1 to 4 are always driven at full speeds so as to secure the function of the image forming apparatus. Moreover, as to the fans 5 to 12 except for the fans 1 to 4, it is assumed that a plurality of patterns B to E in which the combination of the fans to be stopped and the fans to be driven is different from each other are set and that the patterns B to E are switched in response to the number of sheets of paper to be fed.

Specifically, the pattern B is a pattern in which: the fans 5, 6, and 10 are stopped; the fan 7 is driven at full speed; and the fans 8, 9, 11, and 12 are driven at low speeds.

The pattern C is a pattern in which: the fans 8 and 12 are stopped; the fans 6 and 9 are driven at full speeds; and the fans 5, 7, 10, and 11 are driven at low speeds.

The pattern D is a pattern in which: the fans 6, 9, and 11 are stopped; the fans 8, 10, and 12 are driven at full speeds; and the fans 5 and 7 are driven at low speeds.

The pattern E is a pattern in which: the fans 8, 10, and 12 are stopped; the fans 5, 6, and 11 are driven at full speeds; and the fans 7 and 9 are driven at low speeds.

In this regard, the pattern A is a pattern in which all of the fans are driven at full speeds.

The states in which the respective fans are stopped and driven in these patterns B to E are stored in advance in the storage part 105. Further, the combination of operations of stopping, full-speed driving, and low-speed driving the respective fans is set in such a way that the amount of change between the noise level of all the fans when the fans 1 to 12 are driven in an arbitrary pattern and the noise level of all the fans when the fans 1 to 12 are driven in another arbitrary pattern, in other words, the difference in the noise level of all the fans between the respective patterns is preferably limited to within 0.5 dB. This is because if the difference in the noise level between the respective patterns is limited to within 0.5 dB, when one pattern is switched to the next pattern, the user can hardly recognize a change in the sound volume of the fans, which can surely prevent a rapid change in the sound volume from offending the user's ears.

Moreover, the respective patterns include at least one fan to be stopped. This is because the pattern including the fan to be stopped can decrease the noise level of all the fans and can control the difference in the noise level between the respective patterns to within 0.5 dB. However, when the fan to be stopped is fixed, there is a case where the cooling function and the sucking function which are intrinsic to the fan cannot be exerted, so that the fans to be stopped are changed for each of the patterns. In other words, the patterns are changed to prevent the temperature of an object to be cooled from being higher than a predetermined temperature and to decrease the difference in the total sound volume between the respective patterns.

Further, in the example of FIG. 5, each of the patterns includes the fans to be driven at low speeds, but it is not always necessary that each of the patterns includes the fans to be driven at low speeds. However, when each of the patterns includes the fans to be driven at low speeds, the difference in the noise level between the respective patterns can be easily controlled to within 0.5 dB.

In the example of FIG. 5, it is assumed that the pattern is changed with respect to a predetermined number of sheets of paper to be continuously fed in the following manner: the image forming apparatus 100 is driven in the pattern B when the number of sheets ranges from 1 to 50, in the pattern C when the number of sheets ranges from 51 to 100, in the pattern D when the number of sheets ranges from 101 to 150, and in the pattern E when the number of sheets ranges from 151 to 200. Here, the number of sheets of paper to be continuously fed means the ordinal number of sheets printed at this time.

It is recommended that the timing when the pattern is to be changed is determined by the printing operation mode of color or monochrome, single-side printing or both-side printing, the size of paper, and the presence or absence of post handling such as stapling and creasing.

For example, as shown in the table of FIG. 6, in a case where the printing is performed on the sheets of paper to be continuously fed in a printing mode of monochrome, single-side printing, A4 lateral size, without stapler handling, the image forming apparatus 100 is driven in the pattern B when the number of sheets ranges from 1 to 40, in the pattern C when the number of sheets ranges from 41 to 80, in the pattern D when the number of sheets ranges from 81 to 120, and in the pattern E when the number of sheets ranges from 121 to 150.

Further, as shown in the table of FIG. 7, in a case where the printing is performed for the sheets of paper to be continuously fed in a printing mode of monochrome, both-side printing, A4 lateral size, without stapler handling, the image forming apparatus 100 is driven in the pattern B when the number of sheets ranges from 1 to 30, in the pattern C when the number of sheets ranges from 31 to 60, in the pattern D when the number of sheets ranges from 61 to 90, and in the pattern E when the number of sheets ranges from 91 to 120.

In this regard, in this embodiment, the noise levels of all the fans in the pattern B and the pattern C shown in FIGS. 5 to 7 are set at 63.6 dB, the noise levels of all the fans in the pattern D are set at 63.8 dB, and the noise levels of all the fans in the pattern E are set at 64.0 dB. In contrast, the noise level when the fans 1 to 12 are driven at full speed is 64.8 dB.

Figure 8:
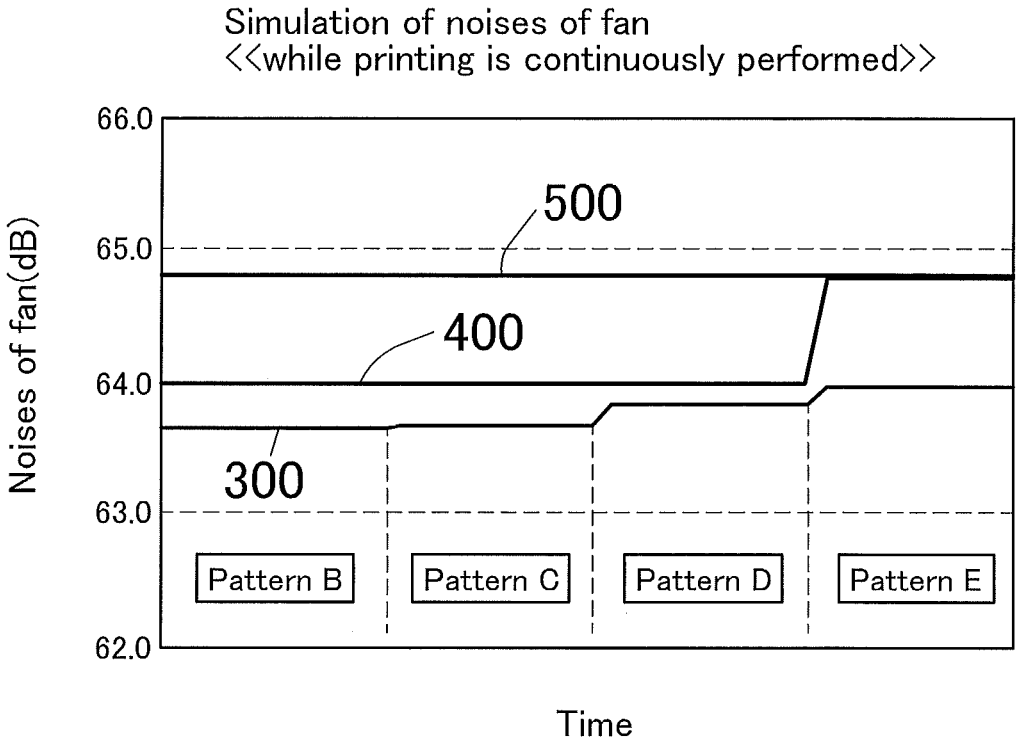
FIG. 8 is a graph to show the relationship between the noise level of the fan and a driving time in the present embodiment.

This noise level of the fans is shown in the graph of FIG. 8. In FIG. 8, a reference numeral 300 shows the relationship between a driving time and the noise level of all the fans when the fans 1 to 12 are driven as shown in the table of FIGS. 5 to 7 in which the pattern is switched from the pattern B to the pattern C, the pattern D, and the pattern E. The noise level is increased stepwise within a range of 0.5 dB as the pattern is switched from the pattern B to the pattern E.

A reference numeral 500 shows the characteristics (pattern A) when all of the fans 1 to 12 are driven at full speeds. It is found that large noises are always produced.

A reference numeral 400 shows the characteristics of the noise levels of the fans in the image forming apparatus described in Japanese Patent Application Laid-Open No. 2009-58587. When it is detected that the interior temperature of the apparatus reaches a specified value, the operating state of the fans are changed to increase the noise level rapidly and this change in the noise level is offensive to the user's ears.

As will be noted from the graph of FIG. 8, in the present embodiment, the driving state of the fans 1 to 12 is switched from the pattern B to the pattern E and the amount of change in the noise level at the time of switching is controlled to within 0.5 dB, so that the noise level of all the fans can be reduced while maintaining the cooling performance and the sucking performance of the fans which are required during the printing operation, and such a disadvantage that a rapid change in the noise levels of the fans is offensive to the user's ears can be resolved.

In this regard, in the embodiment described above, the pattern is switched from the pattern B to the pattern E in such a way that the noise level is increased stepwise. However, it is also recommended that the pattern can be switched in such a way that the noise level is decreased stepwise or can be switched in such a way that the noise level is increased or decreased repeatedly. Further, it is also recommended that after the pattern E, the patterns B to E are repeated, or the pattern is switched to the pattern D, the pattern C, and the pattern B, or the pattern is switched to the pattern other than the patterns B to E.

Furthermore, while the patterns B to E are switched according to the predetermined number of sheets of paper to be continuously fed, it is also recommended that the pattern is switched according to a predetermined operating time in which the printing operation is continuously performed.

The present invention of the subject application having been described above may be applied to the following modes.

[1] An image forming apparatus comprising: a plurality of fans; a drive part for driving each of the fans; and a controller for controlling the drive part in such a way that while the apparatus is operated, a part of the plurality of fans are stopped and the fan to be stopped is changed and the amount of change in a noise level of all the fans before and after the change of the fan to be stopped is limited to within a specified range.

[2] The image forming apparatus as recited in the aforementioned item [1], wherein the controller changes the fan to be stopped in such a way that the noise level of all the fans is increased stepwise or deceased stepwise.

[3] The image forming apparatus as recited in the aforementioned item [1], comprising a storage part for storing a plurality of patterns in which combination of the fan to be stopped and the fan to be driven of the plurality of fans is different, wherein the controller drives the fans according to the respective patterns stored in the storage part and while switching the pattern.

[4] The image forming apparatus as recited in the aforementioned item [3], wherein the controller changes timing when the pattern is to be switched according to an operating mode of the apparatus.

[5] The image forming apparatus as recited in the aforementioned item [1], wherein the amount of change in the noise level of all the fans is limited to within 0.5 dB.

[6] A method for driving and controlling a plurality of fans in an image forming apparatus provided with the fans, the method comprising: driving the fans by a drive part in such a way that while the apparatus is operated, a part of the plurality of fans are stopped and the fan to be stopped is changed and the amount of change in a noise level of all the fans before and after the change of the fan to be stopped is limited to within a specified range.

[7] The method for driving and controlling a cooling fan as recited in the aforementioned item [6], wherein the fan is driven in such a way that the noise level of all the fans is increased stepwise or deceased stepwise.

[8] The method for driving and controlling a fan as recited in the aforementioned item [6], wherein: the image forming apparatus is provided with a storage part for storing a plurality of patterns in which combination of the fan to be stopped and the fan to be driven of the plurality of fans is different; and the fan is driven according to the respective patterns stored in the storage part and while switching the pattern.

[9] The method for driving and controlling a fan as recited in the aforementioned item [8], wherein timing when the pattern is to be switched is changed according to an operating mode of the apparatus.

[10] The method for driving and controlling a fan as recited in the aforementioned item [6], wherein the amount of change in the noise level of all the fans is limited to within 0.5 dB.

According to the mode as described in the item (1), the drive part is controlled in the following way: while the apparatus is operated, a part of the plurality of fans are stopped; the fan to be stopped is changed; and the amount of change in the noise level of all the fans before and after the change of the fan to be stopped is limited to within a specified range. Thus, while the image forming apparatus is operated, a rapid change in the noise level of all the fans can be prevented and hence such a disadvantage that the rapid change in the noise level is offensive to user's ears can be solved. In addition, a part of the fans are stopped, so that the noise level of all the fans can be reduced by a number of fans stopped as compared with a case in which all of the fans are driven.

According to the mode as described in the item (2), the noise level of all the fans is increased stepwise or deceased stepwise, so that a rapid change in the noise level can be prevented.

According to the mode as described in the item (3), it is only necessary to drive the fans according to the respective patterns stored in the storage part and while switching the pattern, so that the control can be easily performed.

According to the mode as described in the item (4), the timing when the pattern is to be switched is changed according to an operating mode of the apparatus, so that cooling performance and the like corresponding to the operating mode can be secured and at the same time a rapid change in the noise level can be prevented.

According to the mode as described in the item (5), the amount of change in the noise level of all the fans is limited to within 0.5 dB, so that a rapid change in the noise level can be reliably prevented.

According to the mode as described in the item (6), while the image forming apparatus is operated, a rapid change in the noise level of the fans can be prevented and hence such a disadvantage that the rapid change in the noise level is offensive to user's ears can be resolved. In addition, a part of the fans are stopped, so that the noise level of all the fans can be reduced by a number of fans stopped as compared with a case where all of the fans are driven.

According to the mode as described in the item (7), the noise level of all the fans is increased stepwise or deceased stepwise, so that a rapid change in the noise level can be prevented.

According to the mode as described in the item (8), it is only necessary to drive the fans according to the respective patterns stored in the storage part and while switching the pattern, so that the control can be easily performed.

According to the mode as described in the item (9), the timing when the pattern is switched is changed according to an operating mode of the apparatus, so that cooling performance and the like corresponding to the operating mode can be secured and at the same time a rapid change in the noise level can be prevented.

According to the mode as described in the item (10), the amount of change in the noise level of all the fans is limited to within 0.5 dB, so that a rapid change in the noise level can be reliably prevented.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g. of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to". In this disclosure and during the prosecution of this application, means-plus-function or step-plus-function limitations will only be employed where for a specific claim limitation all of the following conditions are present In that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example", and "NB" which means "note well".

What is claimed is:

1. An image forming apparatus comprising:

a plurality of fans;

a drive part for driving each of the fans; and a controller for controlling the drive part in such a way that while the apparatus is performing an operation, a first part of the plurality of fans is stopped and a second part of the plurality of fans is rotated, and subsequently the first part of the plurality of fans is rotated while at least one fan in the second part is stopped, and the amount of change in a noise level of all the fans before and after the change of the fan to be stopped is limited to within a specified range.

2. The image forming apparatus as recited in claim 1, wherein the controller changes a fan to be stopped in such a way that the noise level of all the fans is increased stepwise or deceased stepwise.

3. The image forming apparatus as recited in claim 1, comprising:

a storage part for storing a plurality of patterns in which a combination of a fan to be stopped and a fan to be driven of the plurality of fans is different, wherein the controller drives the fans according to the respective patterns stored in the storage part and while switching the pattern.

4. The image forming apparatus as recited in claim 3, wherein the controller changes timing when the pattern is to be switched according to an operating mode of the apparatus.

5. The image forming apparatus as recited in claim 1, wherein the amount of change in the noise level of all the fans is limited to within 0. 5 dB.

6. The image forming apparatus as recited in claim 1, wherein the fan to be stopped is changed based on the number of sheets that are processed by the image forming apparatus.

7. The image forming apparatus as recited in claim 1, wherein the plurality of fans includes sirocco fans and axial fans.

8. The image forming apparatus as recited in claim 1, wherein some of the plurality of fans are provided on a front side of the image forming apparatus and others of the plurality of fans are provided on a rear side of the image forming apparatus.

9. The image forming apparatus as recited in claim 1, wherein fan drive control is performed while sheets of paper are continuously fed and at least one of the fans is constantly stopped by the fan drive control.

10. A method for driving and controlling a plurality of fans in an image forming apparatus provided with the fans, the method comprising:

driving the fans by a drive part in such a way that while the apparatus is performing an operation, a first part of the plurality of fans is stopped and a second part of the plurality of fans is rotated, and subsequently the first part of the plurality of fans is rotated while at least one fan in the second part is stopped, and the amount of change in a noise level of all the fans before and after the change of the fan to be stopped is limited to within a specified range.

11. The method for driving and controlling a cooling fan as recited in claim 10, wherein a fan is driven in such a way that the noise level of all the fans is increased stepwise or deceased stepwise.

12. The method for driving and controlling a fan as recited in claim 10, wherein;

the image forming apparatus is provided with a storage part for storing a plurality of patterns in which a combination of a fan to be stopped and a fan to be driven of the plurality of fans is different; and the fan is driven according to the respective patterns stored in the storage part and while switching the pattern.

13. The method for driving and controlling a fan as recited in claim 12, wherein timing when the pattern is to be switched is changed according to an operating mode of the apparatus.

14. The method for driving and controlling a fan as recited in claim 10, wherein the amount of change in the noise level of all the fans is limited to within 0.5 dB.

15. The method for driving and controlling a fan as recited in claim 10, wherein the fan to be stopped is changed based on the number of sheets that are processed by the image forming apparatus.

16. The method for driving and controlling a fan as recited in claim 10, wherein the plurality of fans includes sirocco fans and axial fans.

17. The method for driving and controlling a fan as recited in claim 10, wherein some of the plurality of fans are provided on a front side of the image forming apparatus and others of the plurality of fans are provided on a rear side of the image forming apparatus.

18. The method for driving and controlling a fan as recited in claim 10, wherein fan drive control is performed while sheets of paper are continuously fed and at least one of the fans is constantly stopped by the fan drive control.

* * * * *